US005492406A

United States Patent [19]

Meyer

[11] Patent Number: 5,492,406

[45] Date of Patent: Feb. 20, 1996

[54] DEVICE FOR THE PROPULSION OF AN OLOID SHAPED TUMBLER BODY

[75] Inventor: Pio Meyer, Wald, Switzerland

[73] Assignee: Bioengineering AG, Wald, Switzerland

[21] Appl. No.: 211,327

[22] PCT Filed: May 27, 1993

[86] PCT No.: PCT/CH93/00137

§ 371 Date: Aug. 5, 1994

§ 102(e) Date: Aug. 5, 1994

[87] PCT Pub. No.: WO94/02237

PCT Pub. Date: Feb. 3, 1994

[30] Foreign Application Priority Data

Jul. 24, 1992 [CH] Switzerland ..... 02352/92

[51] Int. Cl.[6] ..... B01F 9/00

[52] U.S. Cl. ..... 366/208; 366/219; 366/233

[58] Field of Search ..... 366/53, 55, 62, 366/63, 208, 211, 219, 233; 451/326–330; 74/60, 61, 86

[56] References Cited

U.S. PATENT DOCUMENTS

| | | | |
|---|---|---|---|
| 1,657,764 | 1/1928 | Paris . | |
| 2,302,804 | 11/1942 | Schatz | 366/209 |
| 2,376,106 | 5/1945 | Witthofft . | |
| 2,838,291 | 6/1958 | Peebles | 366/63 X |
| 2,991,657 | 7/1961 | Schatz . | |
| 3,186,243 | 6/1965 | Urban . | |
| 3,610,587 | 10/1971 | Schatz . | |
| 3,824,866 | 7/1974 | Schatz | 74/61 |
| 4,277,185 | 7/1981 | Thompson . | |
| 4,307,965 | 12/1981 | Catarious et al. . | |
| 4,341,475 | 7/1982 | Saladin | 366/211 |
| 4,669,225 | 6/1987 | Kuster | 366/219 X |
| 5,360,265 | 11/1994 | Cruse | 366/208 |

FOREIGN PATENT DOCUMENTS

| | | | |
|---|---|---|---|
| 3542285 | 8/1986 | Germany . | |
| 197841 | 11/1964 | Sweden | 366/63 |
| 242218 | 9/1946 | Switzerland | 74/86 |
| 422723 | 10/1967 | Switzerland . | |
| 500000 | 12/1970 | Switzerland . | |
| 1197713 | 12/1985 | U.S.S.R. . | |
| 1607922 | 11/1990 | U.S.S.R. | 366/219 |
| 865225 | 4/1961 | United Kingdom . | |

*Primary Examiner*—Charles E. Cooley
*Attorney, Agent, or Firm*—Jenkens & Gilchrist

[57] ABSTRACT

A tumbler body with an oloid hollow body (7) is positioned on two free-moving, endless conveyor belts (8). A strip (10) runs around and is attached to the hollow body (7) limited by two profiles (9). The strip (10) maintains a positive connection to a driving element in form of an endless belt. The profiles (9) sink into the area of the guiding and driving system (11) in between the conveyor belts (8). The system contains and combines a guide for guiding the profiles (9) and a drive for driving the driving elements. The conveyor belts (8) glide on the low-friction tables (12) supported by a frame (14) which is also the attachment point for the guiding and driving system. The frame (14) is supported by a base (15). During the rolling process on the conveyor belts (8), the hollow body (7) has a tumbling motion, during which the profiles (9) in the area of the guiding and driving system (11) sink to their lowest point and the tangents at the profiles (9) are always in the moving direction of the conveyor belts (8) at this lowest point.

17 Claims, 8 Drawing Sheets

DEVICE FOR THE PROPULSION OF AN OLOID SHAPED TUMBLER BODY

BACKGROUND OF THE INVENTION

1. Field of the Invention

The present invention relates to a device for the propulsion of a tumbler body and, more particularly, to a device for the propulsion of a tumbler body in the shape of an oloid.

2. History of the Related Art

CH-patent 500 000 describes a device for the generation of a tumbling motion. This device consists of a body that Paul Schatz, in his book "Rhythmusforschung and Technik" (Stuttgart 1975), refers to as an "oloid." This oloid, according to CH-A1 500 000, is driven by a conveyor belt which carries the oloid. This drive was not very popular in practical applications, because it requires a perfectly shaped oloid and no slip during the rolling of the oloid. Guide rollers, which are commonly used on drum-shaped rolling elements, cannot be used with the shape of the oloid. Even though it has, much like a cylinder, a straight contact line on one plane, the angle of this contact line changes in an oscillatory manner with respect to the direction of travel. Therefore, the invention never became successful. This is not the case with the solution presented in CH-patent 216 760 in which a hollow body, executing a tumbling motion, is part of a half Bricard chain. This solution has been successful in the market employing various designs and different means of propulsion. But it has the tremendous disadvantage that prevents the construction of a mixer based on the oloid or inversion principle with a capacity of one or more cubic meters. This disadvantage is caused by the high mass forces occurring during operation that constantly change in size and direction. These mass forces require extremely large components and, thus, represent extreme challenges to the base of such a machine.

The purpose of this invention is the creation of a drive for an oloid body that overcomes these disadvantages and is also suited for oloids with large dimensions.

SUMMARY OF THE INVENTION

The present invention relates to a device for the propulsion of a tumbler body. More particularly, one aspect of the invention comprises a device for the propulsion of a tumbler body consisting of an oloid tumbler body, a rolling device and means for the propulsion and guidance of the tumbler body positioned on the rolling device characterized by two profiles leading around the tumbler body and attached to it arranged in such a way that they are located on the edges of a strip which is continuous and straight for the level rolling of the tumbler body and positioned in its longitudinal axis. A second strip is placed on top of the first strip that is attached to the tumbler body and carries the profiles and has those form elements suitable for the positive connection of a driving element. A frame supports the rolling device on which the tumbler body is positioned and which is passively moved by it. The frame supports the guiding and driving system in which the means for the propulsion and guiding of the tumbler body are installed and collected. Rollers are provided in the guiding and driving system to apply the guiding forces on the profiles. A driving element is provided in the form of a conveyor belt that is positioned along the second strip around the tumbler body and forms a positive connection with it. A driving wheel is positioned in the guiding and driving system around which forms a positive connection with the driving element and can be driven by the driving wheel. Two fairleads are provided in the guiding and driving system for the shifting of the driving element from the positive connection on the second strip to the driving wheel, with the fairleads as closely arranged as possible to the second strip and each other.

In another aspect, the above described invention includes the tumbler body being an oloid hollow body, and the rolling device is a roller carpet consisting of free-moving rollers running parallel to each other, with the axial direction of the rollers forming the roller carpet perpendicular to the rolling direction of the hollow body.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
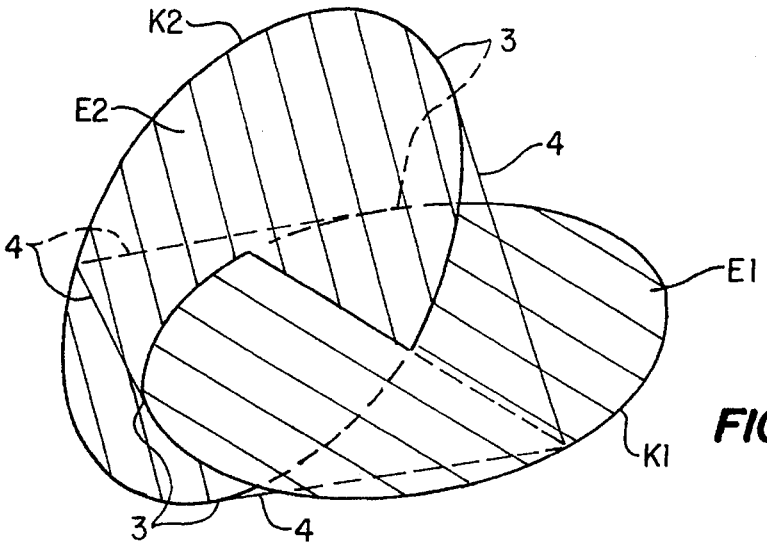
FIG. 1 is a first geometric illustration of the basics.

An oloid, according to Paul Schatz, is, among other possibilities, defined as a body resulting from two rolling bodies of equal circles $K_1$, $K_2$, which lie in planes $E_1$, $E_2$ perpendicular to each other, penetrating each other in such a way that the periphery of one runs through the center of the other, as illustrated in FIG. 1. The circles can also be in form of ellipses.

Figure 2:
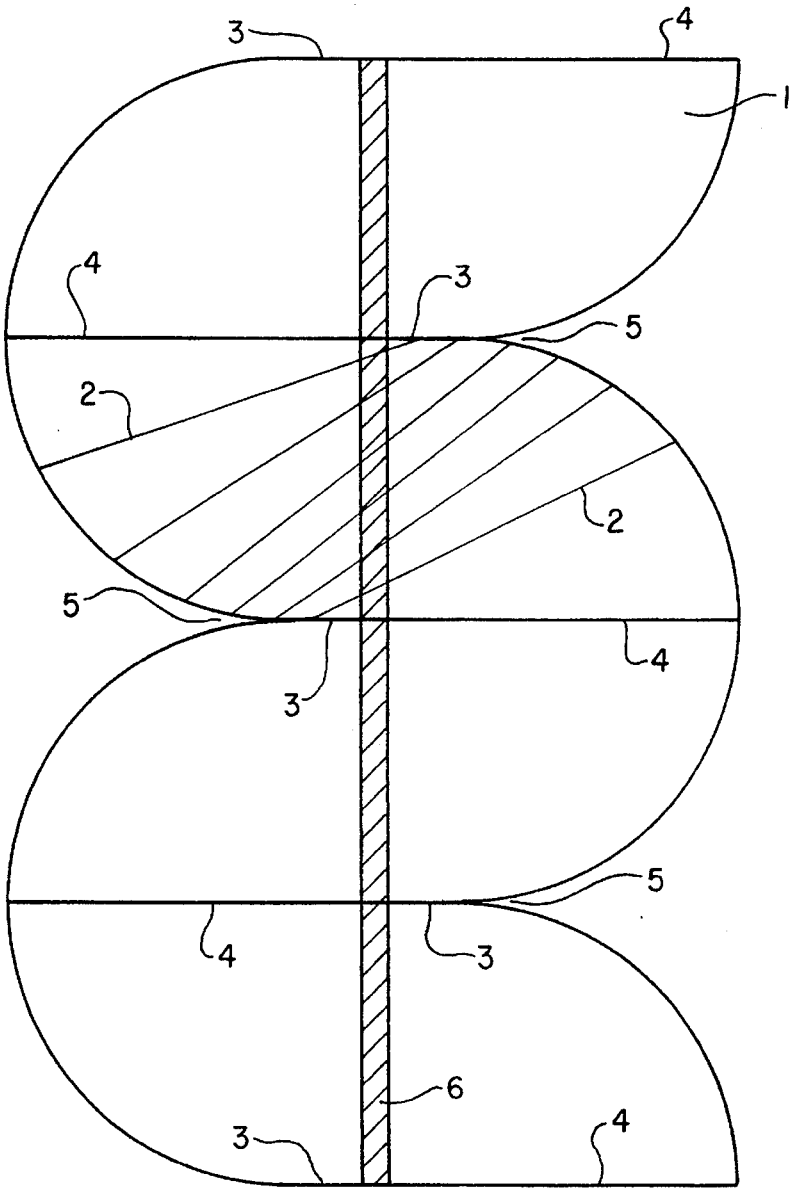
FIG. 2 is a second geometric illustration of the basics.

FIG. 2 illustrates the path 1 of an oloid rolling on a plane. When an oloid is rolled along a plane, the oloid will always have a straight contact line 2 with on the path 1 of the plane. FIG. 2 illustrates some of contact lines 2 along the path 1. These contact lines 2 have four distinct lines that are referred to as tangent lines 4 in this illustration. The tangent lines 4 are the contact lines 2 which lay in planes $E_1$, $E_2$. The contact points of the tangent lines 4 with the circles $K_1$, $K_2$ are tangent points 3. In the rolling movement according to FIG. 2, the tangent points 3 are the lowest points in the indentations 5. A strip 6 is located between the tangent points 3 belonging to circle $K_1$, and circle $K_2$, respectively. The strip 6 does not lead over an edge of the oloid or over one of the circle lines $K_1$, $K_2$, but has a plane rolling movement and a straight-line border.

Figure 3A:
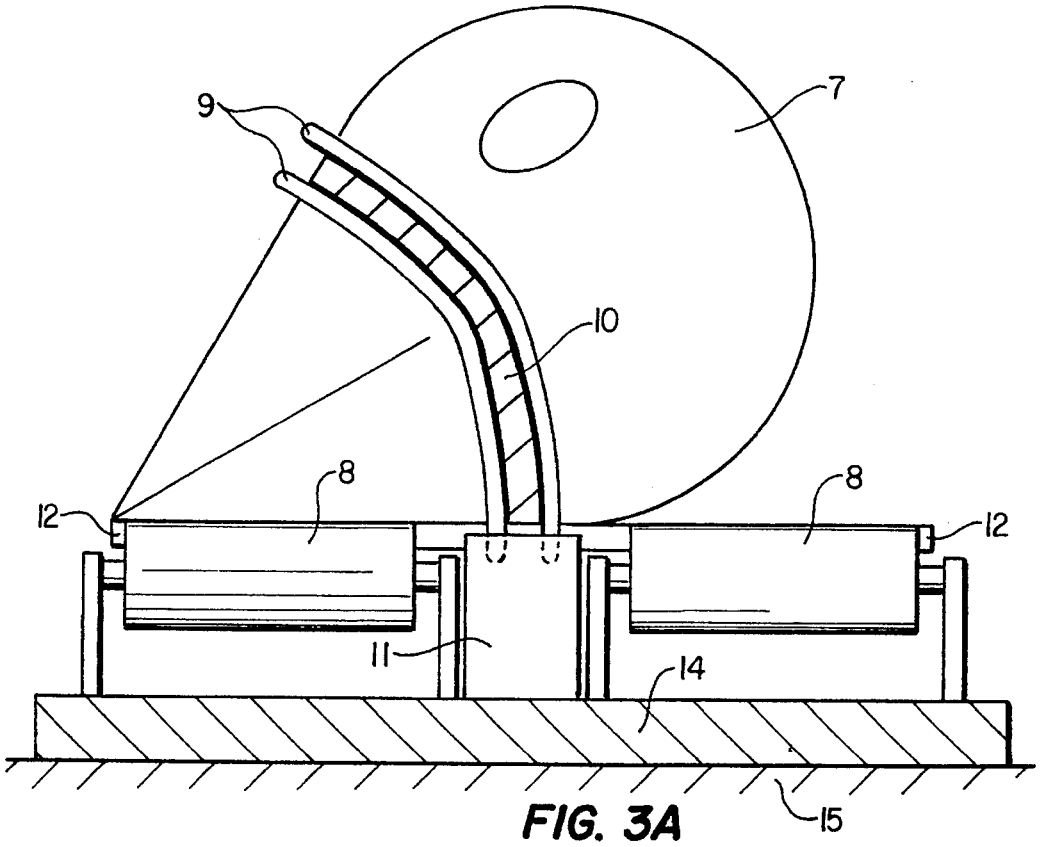
FIGS. 3*a,b* show an illustration of the inventive device in two views.
Figure 3B:
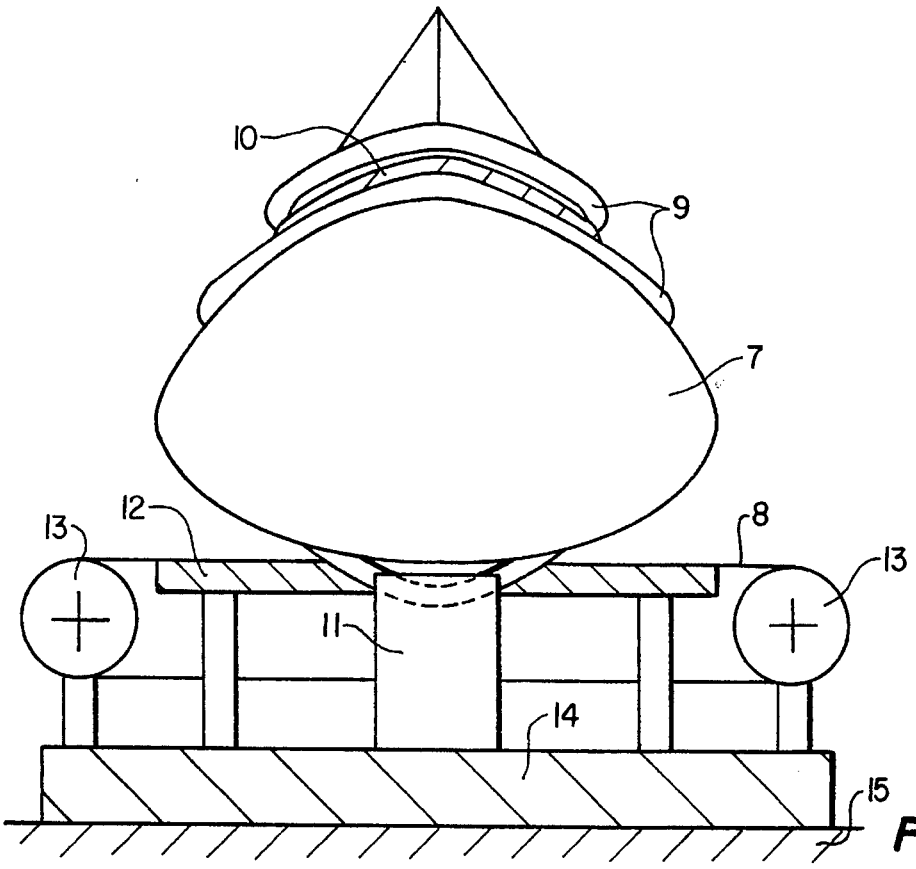
FIG. 3*c* is another version of the inventive device in FIGS. 3*a* and 3*b*.
Figure 3C:
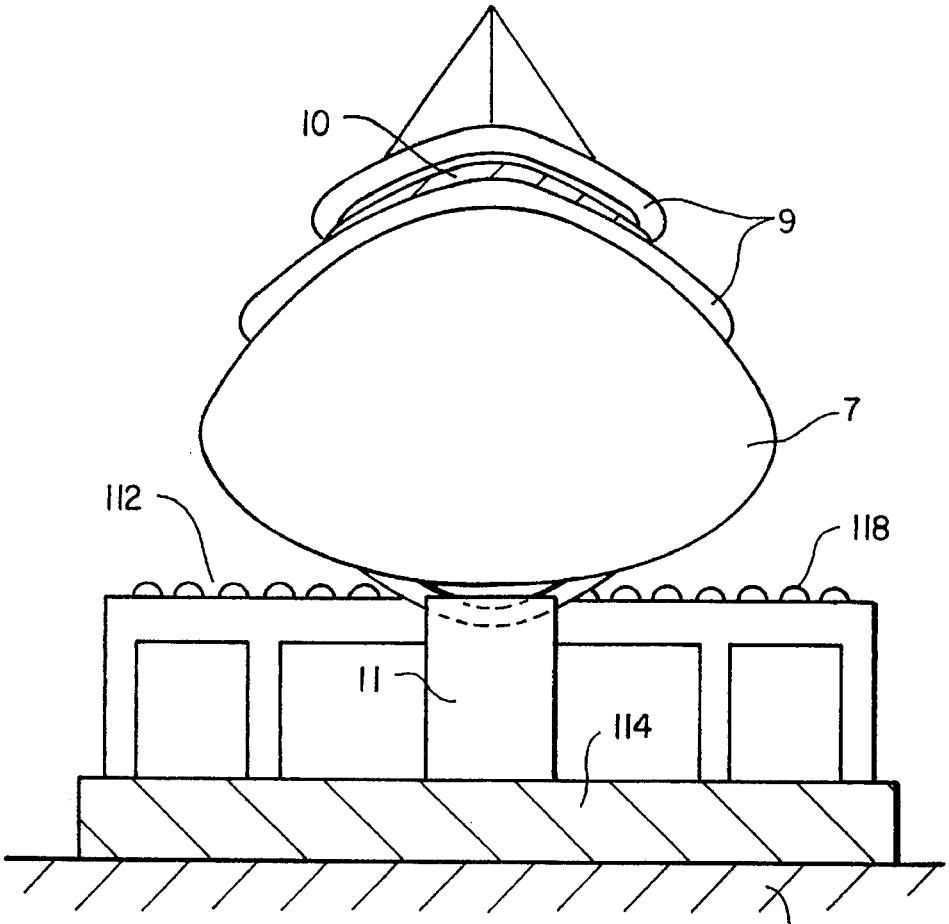

FIGS. 3*a* and 3*b* illustrate the schematic drawing of a first design version of the inventive device. FIG. 3*c* illustrates a schematic drawing of another design version of the inventive device in FIGS. 3*a* and 3*b*. A hollow body 7 in shape of an oloid is placed on two freely moving conveyor belts 8 (shown in FIGS. 3*a* and 3*b*), or a roller carpet 112 of freely moving rollers 118 (shown in FIG. 3*c*). For clarity, the conveyor belt 8 facing the viewer in FIG. 3*b* and the rollers 118 facing the viewer in FIG. 3*c*, are not illustrated. Two profiles 9 run within the strip 6 illustrated in FIG. 2 which passes around the hollow body 8. These profiles 9 can be seen in detail in FIGS. 4*a*, 4*b* and 4*c*. A strip 10 is positioned between the profiles 9, whose rolling movement according to FIG. 2 is level. This strip 10 is used for the attachment of the profiles 9 and is designed in such a way that it is suited for the positive connection of a driving element, such as a cogged V-belt, a flat belt or a driving chain. In the area of the strip 6, according to FIG. 2, the strip 10 is attached to the tumbler body, here hollow body 7. A driving and guiding system 11 is installed between the conveyor belts 8 in FIG. 3*b*, or the rollers 118 in FIG. 3*c*, and is shown in detail in FIG. 5. The profiles 9 are pointing vertically down in a small area within the driving and guiding system 11, and are parallel to the direction of movement for the conveyor belts 8 in FIGS. 3*a* and 3*b*, and perpendicular to the rotational axis of the rollers 118 in FIG. 3*c*. The conveyor belts 8 in FIGS. 3*a* and 3*b* each cross over a low-friction table 12 and two rollers 13. The table 12, rollers 13, and the driving and guiding system 11 in FIGS. 3*a* and 3*b* are connected to a frame 14 that is secured in a base 15. The rollers 118 in FIG. 3*c* are also connected to a frame 114 that is secured in a base 115.

Figure 4A:
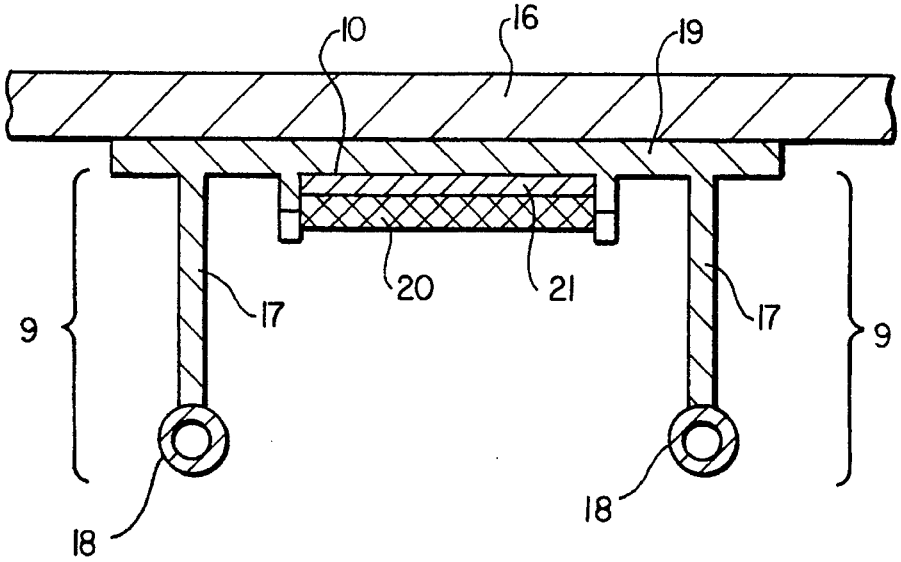
FIG. 4*a* is a first design version of a device component.
Figure 4B:
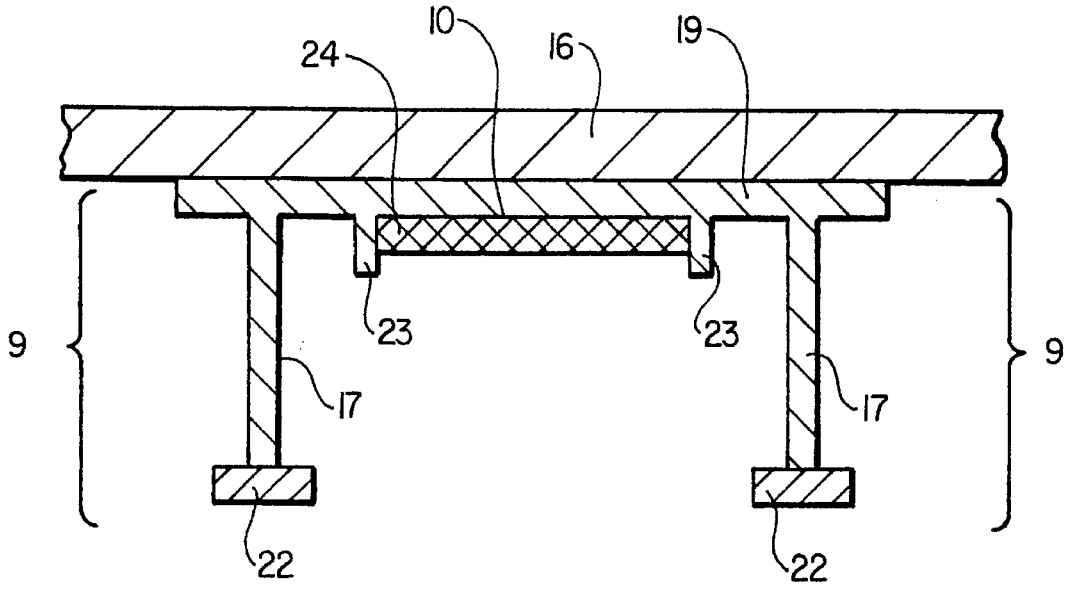
FIG. 4*b* is a second design version of a device component.
Figure 4C:
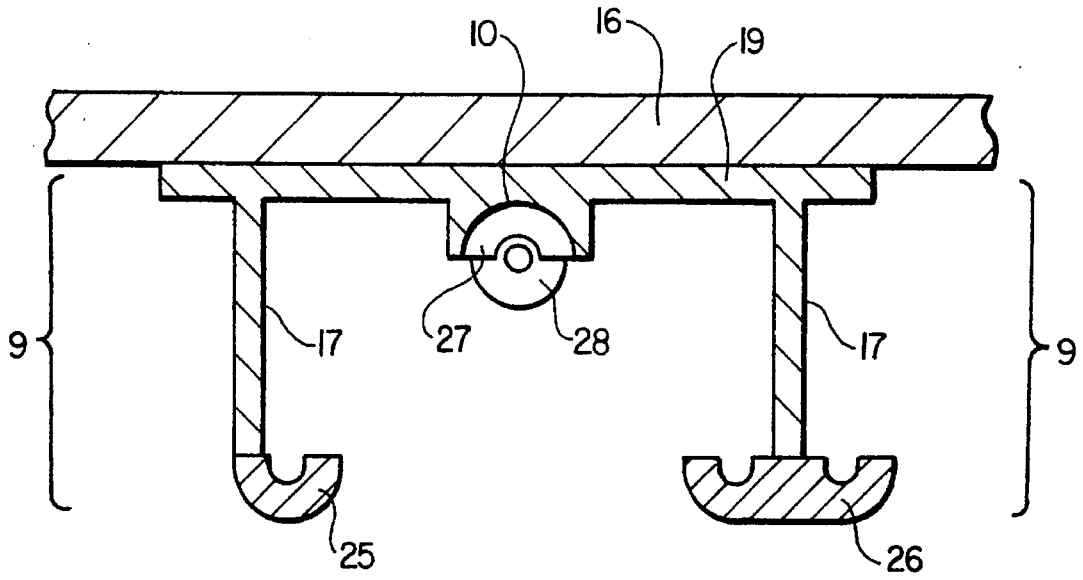
FIG. 4*c* is a third design version of a device component.

FIGS. 4*a*, 4*b* and 4*c* illustrate three design versions of profiles 9 according to FIGS. 3*a*, 3*b*and 3*c*. The number 16 refers to the walls of the hollow body 7. The profiles 9 in FIG. 4*a* include a tube 18 attached to the hollow body 7 by a rib 17 and are connected together by welding or such. The profiles 9 in FIG. 4*b* include a transverse belt 22 which is connected to the rib 17 by welding or the like. The rib 17 can be a one-piece construction or made of individual rods. The strip 10 is positioned between the rods 17 and attached by a common base plate 19. In the design version of FIG. 4*a*, the strip 10 has indentations 21 which holds a cogged V-belt 20 from the drive of the driving and guiding unit 11 in FIGS. 3*a*, 3*b*, and 3*c*. In the design version of FIG. 4*b*, the strip 10 is recessed between two ribs 23 and has a flat shape to accommodate a flat belt 24 from the drive of the driving and guiding unit 11 in FIGS. 3*a*, 3*b*, and 3*c*.

In the design version according to FIG. 4*c*, the ribs 17 attach a channel-shaped profile 25 to the hollow body 7, as seen in the left part of FIG. 4*c*, or attach a two channel profile 26 to the hollow body 7, as seen in the right part of FIG. 4*c*. Here, too, a welding connection between the rib 17 and the profile 25 or 26 is possible. The strip 10 mainly contains semi-circular indentations 27 to accommodate a rosary chain 28 from the drive in the driving and guiding unit 11 of FIGS. 3*a*, 3*b*, and 3*c*.

It is perfectly within the scope of this invention to combine any of the driving elements illustrated in FIGS. 4*a*, 4*b* and 4*c* with any of the shown profiles 9. The illustrated combinations are only used as examples.

The driving and guiding system 11 contains the means for the propulsion of the hollow body 7 and its guidance by means of the profiles 9. The driving elements and the guiding elements are both illustrated in FIGS. 5 and 6. FIGS. 7*a*, 7*b* and 7*c* illustrate only the guiding elements.

Figure 5:
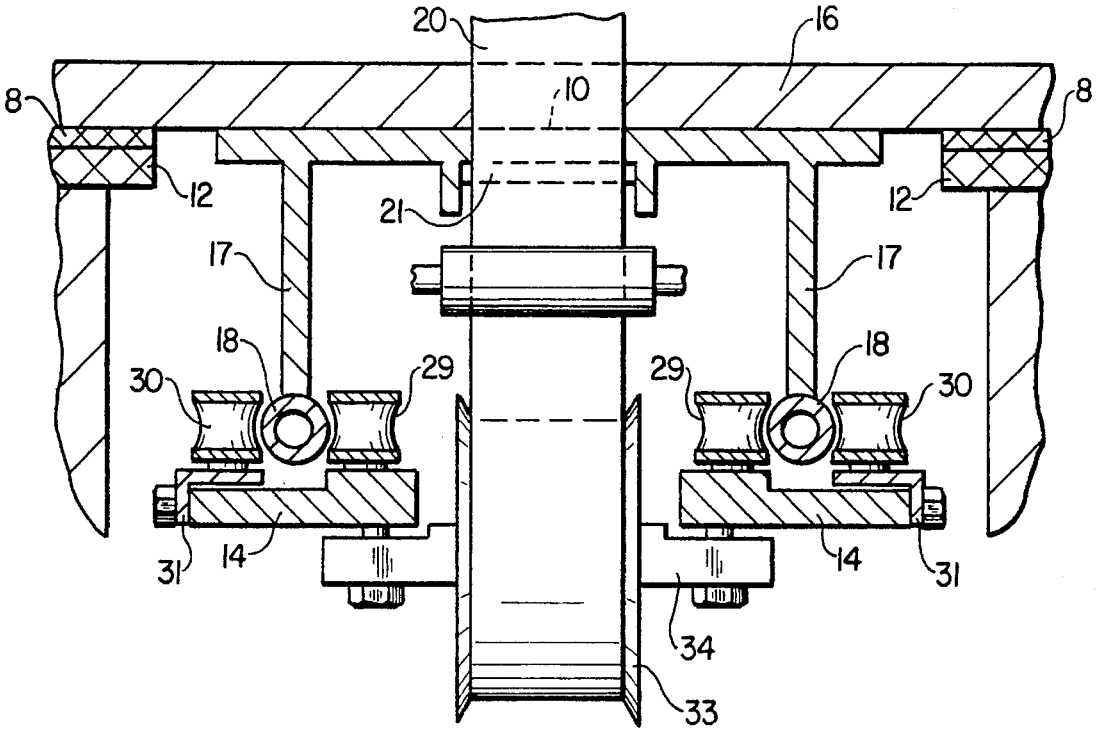
FIG. 5 is a design version of the inventive drive and guiding elements in a frontal view.

FIG. 5 illustrates a design version of the guiding and driving system 11 based on the design version of the profiles 9 illustrated in FIG. 4*a*. The oloid hollow body 7, of which only its walls are shown, is positioned on the two conveyor belts 8 that, in turn, are themselves positioned on the table 12. The profiles 9 surrounding the hollow body 7 sink in between the conveyor belts 8. The movement direction of the profiles 9 in the area of the contact line between the hollow body 7 and the conveyor belts 8 is, as illustrated, always parallel to the movement direction of the conveyor belts 8. This is also the point at which the profiles 9 sink to their lowest point under the level of the conveyor belts 8. At this point, each tube 18 is guided between two rollers 29, 30 with the four rollers 29, 30 arranged in one straight line. Both roller pairs 29, 30 have a channel-shaped cross-section resembling that of the tube 18. Thus, they can transmit forces in a radial and axial direction (referring to rollers 29, 30) onto the tube 18. The axes of the rollers 29 are attached directly to the frame 14, while the axes of the rollers 30 are connected to the frame 14 by means of a solid spring assembly, such as an elbow 31. In strip 10, a cogged V-belt 20 forms a positive connection with the indentation 21. In the shown area, the cogged V-belt 20 runs across two fairleads 32 (only one is shown in FIG. 5) and embraces with its toothed side a driver 33, e.g. an external-rotor motor with an axle 34. In order to adjust the belt tension, the axle 34 may be connected to the frame 14 with set screws (not shown). The axles of the rollers 32 are connected to the frame 14 (not illustrated). The fairleads 32 are located as close as possible to strip 10, and also to each other, so that the points at which the driving element is released from the strip 10 are closest to the lowest point of the strip 10.

Figure 6:
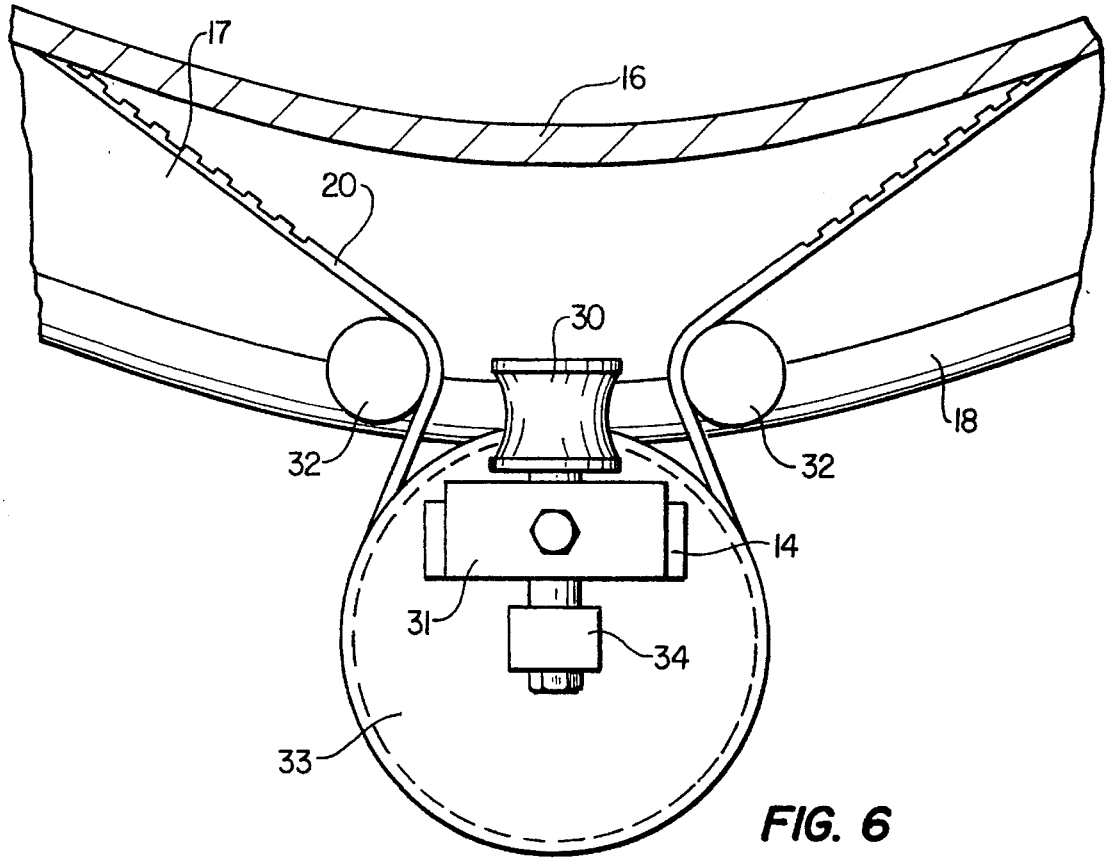
FIG. 6 is the design version from FIG. 5 in a side view.
Figure 7A:
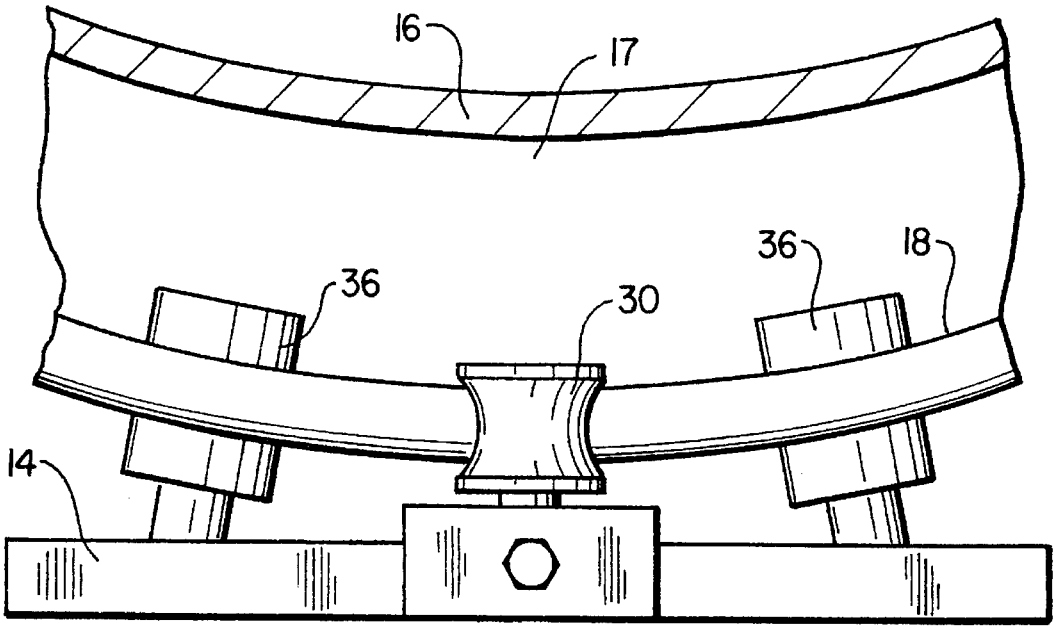
FIG. 7*a* is a second design version of a guiding element.
Figure 7B:
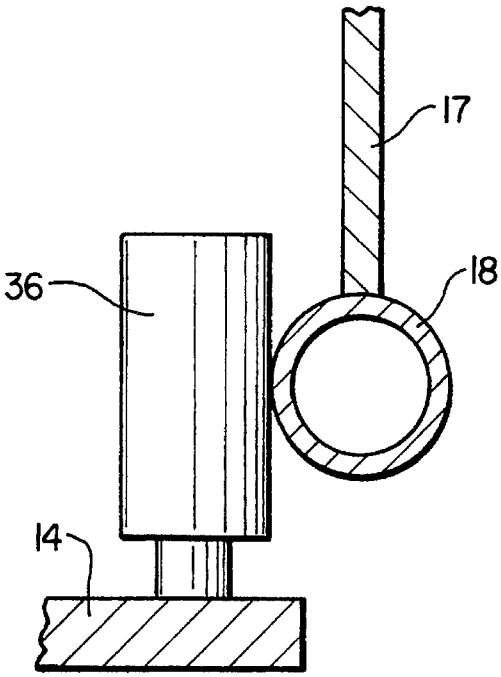
FIG. 7*b* is a third design version of a guiding element.
Figure 7C:
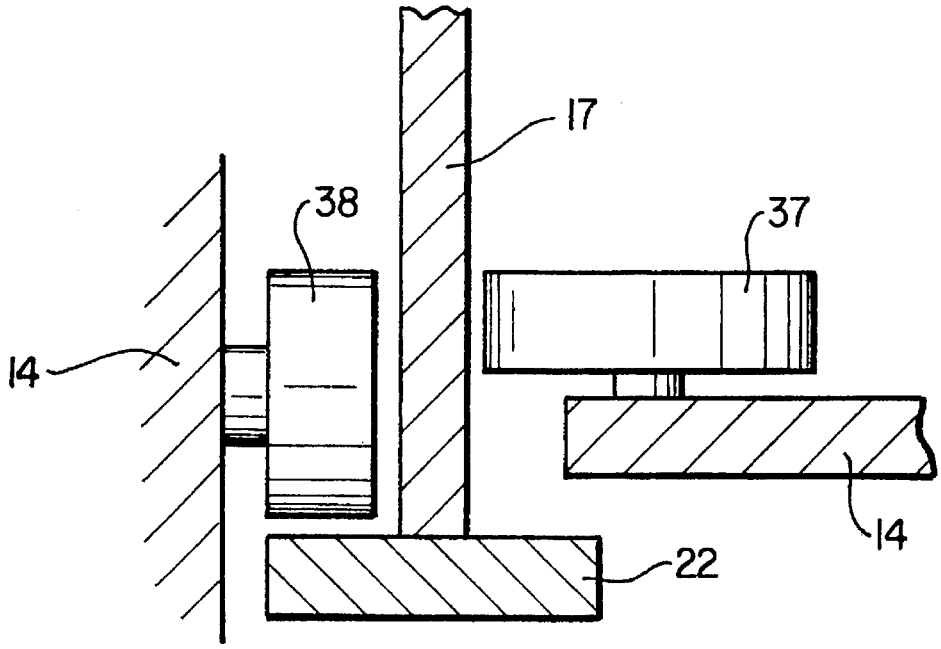
FIG. 7*c* is a fourth design version of a guiding element.

The same device is illustrated in a side view in FIG. 6. The view is from the right with regard to FIG. 5. The right rib 17 and the right tube 18 have been removed. Of the roller pairs 29, 30 only the right roller 30 is shown. As mentioned earlier, this invention permits the use of a flat belt 24 or a rosary chain 28 instead of the shown cogged V-belt 20.

While the kind of drive is the same with regard to the characteristics of this driving element, the kind of guiding for the profiles 9 changes with the type of profile. FIGS. 7*a*, 7*b*, 7*c*, 7*d*, and 7*e* illustrate not only the design versions of the profiles 9, but also their corresponding guiding elements.

Only one of the two profiles 9 is shown.

FIG. 7*a* illustrates a design version having two slightly angled, cylindrical rollers 36 which are attached opposite the solidly, spring-supported roller 30. The roller 30 absorbs radial and axial forces, while the rollers 36 only absorb radial forces. The axle distance of the cylindrical rollers 36 is small, since the tangent direction of the tube 18 in the area of the roller 30 runs only parallel to the direction of the conveyor belts 8 (shown in FIGS. 3*a* and 3*b*). Another variation of this design is illustrated in FIG. 7*b*. In the version of FIG. 7*b*, a roller 36 engages each tube 18, and both of the rollers 36 engage the tubes 18 on either the inside or the outside of the profiles 9. In the version of FIG. 7*b*, the spring effect needed for the construction tolerances is supplied by the ribs 17.

FIG. 7*c* illustrates the guiding element working in conjunction with the profile 9 from FIG. 4*b*: A cylindrical roller 37 guides the rib 17 in a lateral direction; a second, cylindrical roller 38 guides the band 22 with regard to its height position. The assembly on the second profile 9 is reversed so that the lateral guiding forces can oppose each other.

Figure 7D:
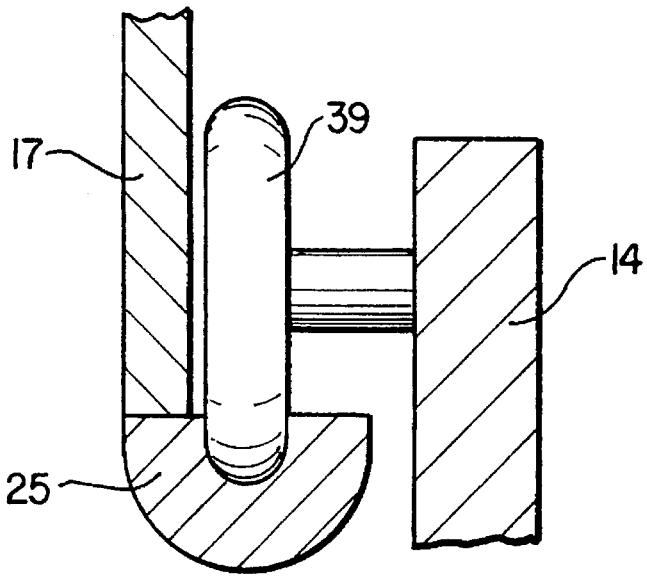
FIG. 7*d* is a fifth design version of a guiding element.

In the design version according to FIG. 7*d* (based on FIG. 4*c*), a roller 39, adjusted to the hollow shape of the profile 25, is meshed with this profile 25 and guides the profile 9, having the rib 17 and the profile 25, in radial as well as axial direction (relative to the roller 39). According to the right side of FIG. 4*c*, two rollers 39 are intended for the guidance of profile 9.

Figure 7E:
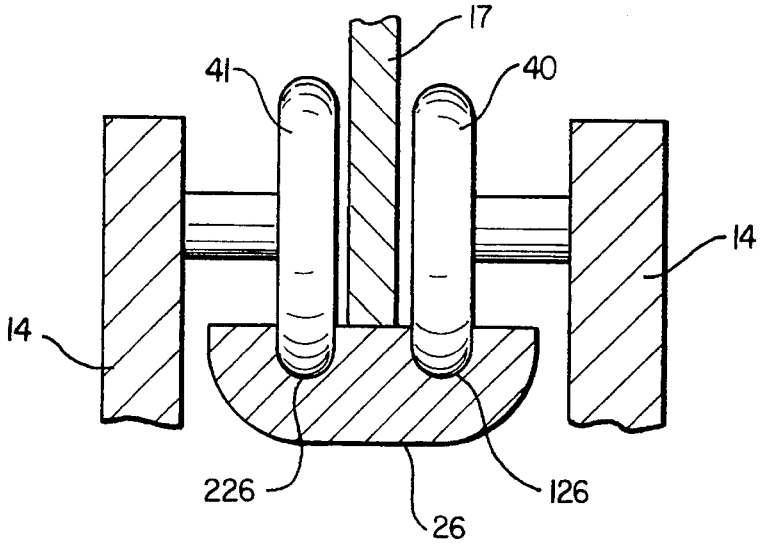
FIG. 7*e* is a sixth design version of a guiding element.

In the design version according to FIG. 7*e* (based on FIG. 4*c*), the profile 26 is attached to the rib 17 and has a first channel 126 and a second channel 226. A first roller 40, adjusted to the hollow shape of the first channel 126, is received by the first channel 126 of the profile 26 and exerts vertical and lateral guiding forces on the profile 26. A second roller 41, adjusted to the hollow shape of the second channel 226, is received by the second channel 226 of the profile 26 and exerts vertical and lateral guiding forces on the profile 26.

Figure 8:
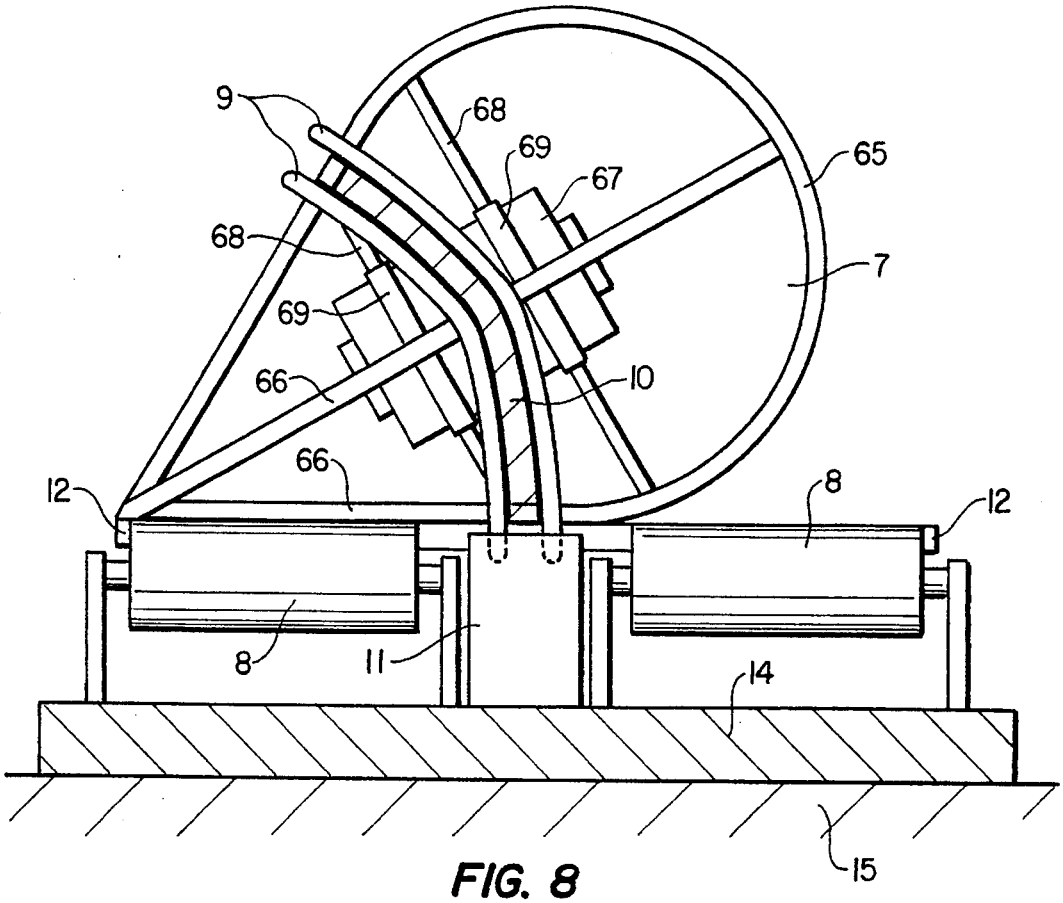
FIG. 8 is a variation of the design version according to FIG. 3*a, b*.

FIG. 8 is an illustration of a second design version of a tumbler body and, thus, a variation of FIGS. 3*a*, 3*b*, and 3*c*. In this case, the tumbler body is a skeleton body 66. It is made of partially curved arcuate rods 65 and has the same rolling behavior as the hollow body 7. Its rolling pattern is essentially the same, the only difference is that from a strictly mathematical point of view it only touches the flat base in two points. In this version, the contact lines 2 illustrated in FIG. 2 are the connecting lines of the two contact points that are always only located in the outlines of the rolling pattern illustrated in FIG. 2. On the inside, the skeleton body 66 may have a simply-shaped vessel 67, such as a commercial chemical drum, that is attached with rods 68 and belts 69. The strip 10 with the profiles 9 and the form elements required for the positive connection of the driving elements, such as a cogged V-belt 20, are attached to the partially curved arcuate rods 65. The other characteristics of the design version according to FIG. 8 are the same as the ones in FIGS. 3*a*, 3*b*, 3*c*, 5 and 6.

If the tumbler body is an oloid hollow body 7 according to FIGS. 3*a*, 3*b*, and 3*c*, the two conveyor belts 8, can also be replaced by two roller carpets (not shown). These roller carpets comprise many individual, free-moving rollers that are parallel to each other and whose axial direction is the same as that of the rollers 13, i.e. perpendicular to the rolling direction of the tumbler body.

It is thus believed that the operation and construction of the present invention will be apparent from the foregoing description. While the method and apparatus shown or described has been characterized as being preferred it will be obvious that various changes and modifications may be made therein without departing from the spirit and scope of the invention as defined in the following claims.

What is claimed is:

1. A device comprising:

an oloid tumbler body having a continuous strip passing around a periphery of said oloid tumbler body and having two profiles, wherein one of the profiles is positioned on each side of the continuous strip, each of the profiles extending outward from said oloid tumbler body;

a frame having means for supporting said tumbler body which allows said oloid tumbler body to roll in position;

a guiding and driving system attached to said frame, said guiding and driving system including:

means for applying guiding forces to the profiles of said oloid tumbler body, thereby maintaining the position of said oloid tumbler body on the means for supporting said tumbler body of said frame; and means for driving said oloid tumbler body having a driving wheel, a drive element positioned around a portion of the driving wheel and positioned around a portion of the continuous strip of said oloid tumbler body, and two fairleads contacting the drive element so as to cause continuous contact between the drive element and the driving wheel and continuous contact between the drive element and the continuous strip of said oloid tumbler body, whereby the means for driving causes said oloid tumbler body to roll on the means for supporting said tumbler body of said frame.

2. The device according to claim 1, wherein the means for supporting said tumbler body comprises a roller carpet having a plurality of free turning rollers, each of the rollers having a rotational axis parallel to the rotational axis of the other rollers and perpendicular to the direction of movement of said oloid tumbler body.

3. The device according to claim 1, wherein the means for supporting said tumbler body of said frame comprises a first free-moving horizontal conveyor belt running around a first roller and a second roller, a second free moving horizontal conveyor belt running around a third roller and fourth roller, and a low-friction table providing support to said first free-moving horizontal conveyor belt and said second free-moving horizontal conveyor belt.

4. The device according the claim 1, wherein said oloid tumbler body comprises a skeleton body having arcuate rods shaped to have an exterior shape of an oloid.

5. The device according to claim 1, wherein the drive element of said guiding and driving system comprises a cogged V-belt.

6. The device according to claim 1, wherein the drive element of said guiding and driving system comprises a flat belt.

7. The device according to claim 1, wherein the drive element of said guiding and driving system comprises a rosary chain.

8. The device according to claim 1, wherein each of the profiles of said oloid tumbler body comprise a tube connected to said oloid tumbler body by a rib.

9. The device according to claim 8, wherein the means for applying guiding forces of said guiding and driving system comprises for each of the profiles:

a first roller rotatably attached to said frame wherein said first roller has a channel-shaped cross-section which receives the tube of said oloid tumbler body;

a second roller resiliently and rotatably attached to said frame, wherein said second roller has a channel-shaped cross-section which receives the tube of said oloid tumbler body; and wherein said first roller and said second roller restrict radial movement of the tube, thereby exerting guiding forces to said oloid tumbler body.

10. The device according to claim 8, wherein the means for applying guiding forces of said guiding and driving system comprises for each of the profiles:

a first roller resiliently and rotatably attached to said frame, wherein said first roller has a channel-shaped cross-section which receives the tube of said oloid tumbler body;

a second roller and a third roller rotatably attached to said frame, wherein said second and third rollers are cylindrical in shape; and wherein said second and third rollers engage the tube of said oloid tumbler body on an opposing side of the tube from where said first roller contacts the tube, wherein said first roller and said second and third rollers restrict radial movement of the tube, thereby exerting guiding forces to said oloid tumbler body.

11. The device according to claim 8, wherein the means for applying guiding forces of said guiding and driving system comprises two cylindrical rollers rotatably attached to said frame, wherein a first of the cylindrical rollers presses against the tube of a first of the profiles and a second of the cylindrical rollers presses against the tube of a second of the profiles, and wherein the cylindrical rollers exert lateral guiding forces against the tubes.

12. The device according to claim 11, wherein each of the profiles of said oloid tumbler body comprises a band connected to said oloid tumbler body by a rib.

13. The device according to claim 12, wherein the means for applying guiding forces of said guiding and driving system comprises for each of the profiles:

a first roller rotatably attached to said frame, wherein said first roller exerts lateral forces on the rib of said oloid tumbler body; and a second roller rotatably attached to said frame, wherein said second roller exerts vertical forces on the band of said oloid tumbler body.

14. The device according to claim 1, wherein each of the profiles of said oloid tumbler body comprise a channel-shaped profile attached to said oloid tumbler body by a rib.

15. The device according to claim 14, wherein the means for applying guiding forces of said guiding and driving system comprises for each of the profiles a roller rotatably attached to said frame wherein said roller has a rounded cross-section which is received by the channel-shaped profile of said oloid tumbler body, thereby exerting vertical and lateral guiding forces to said oloid tumbler body.

16. The device according to claim 1, wherein each of the profiles of said oloid tumbler body comprise a two-channel profile attached to said oloid tumbler body by a rib, wherein a first channel of the two-channel profile is positioned on a first side of the rib, and a second channel of the two-channel profile is positioned on a second side of the rib.

17. The device according to claim 16, wherein the means for applying guiding forces of said guiding and driving system comprises for each of the profiles:

a first roller rotatably attached to said frame, wherein said first roller has a rounded cross-section which is received by the first channel of the two channel profile, thereby exerting vertical and lateral guiding forces on said oloid tumbler body; and a second roller rotatably attached to said frame, wherein said second roller has a rounded cross-section which is received by the second channel of the two channel profile, thereby exerting vertical and lateral guiding forces on said oloid tumbler body.

* * * * *